US007013808B1

(12) United States Patent
Perruzzi et al.

(10) Patent No.: US 7,013,808 B1
(45) Date of Patent: Mar. 21, 2006

(54) METHOD AND SYSTEM FOR DETERMINING A BOUNDING REGION

(75) Inventors: Joseph J. Perruzzi, Tiverton, RI (US); Edward J. Hilliard, Jr., Middletown, RI (US); Megan M. Gibson, Bristol, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 127 days.

(21) Appl. No.: 10/863,837

(22) Filed: Jun. 7, 2004

(51) Int. Cl.
*F42B 22/10* (2006.01)

(52) U.S. Cl. ..... 102/411; 114/238

(58) Field of Classification Search ..... 102/411, 102/406; 114/20.1, 20.2, 238
See application file for complete search history.

(56) References Cited

U.S. PATENT DOCUMENTS 4,682,953 A 7/1987 Doerfel et al.
5,556,281 A 9/1996 FitzGerald et al.
5,819,676 A 10/1998 Cwalina
5,824,946 A * 10/1998 Cwalina ..... 114/21.3
6,112,667 A * 9/2000 Bailey et al. ..... 102/411
6,186,441 B1 2/2001 Schneideriet
6,262,680 B1 7/2001 Muto

* cited by examiner

*Primary Examiner*—Michael J. Carone
*Assistant Examiner*—Gabriel J. Klein
(74) *Attorney, Agent, or Firm*—Jean-Paul A. Nasser; James M. Kasischke; Michael P. Stanley

(57) ABSTRACT

A method for determining a bounding region for a launched weapon. The method processes the course and speed of ocean currents, and the bearing and range to an aim point to determine the resultant speed of the launched weapon. The method then processes the resultant speed to determine a course for the weapon. The method also processes the ownship position at launch, the desired aim point and the resultant speed to determine weapon run time. The method provides a mathematical distribution of the uncertainty in the speed and course of the ocean current and then processes it to generate a scatter region of possible weapon positions. The method then processes the distribution function of the mathematical distribution and the desired aim point to determine a plurality of positions that define a bounding region. Finally, the method quantifies possible positions of the scatter region that are within the bounding region.

10 Claims, 8 Drawing Sheets

METHOD AND SYSTEM FOR DETERMINING A BOUNDING REGION

STATEMENT OF GOVERNMENT

The invention described herein may be manufactured and used by or for the Government of the United States of America for governmental purposes without the payment of any royalties thereon or therefore.

CROSS REFERENCE TO OTHER RELATED APPLICATIONS

Not applicable.

BACKGROUND OF THE INVENTION (1) Field of the Invention

The present invention generally relates to a method for determining a bounding region within which a launched weapon will ultimately be positioned.

(2) Description of the Prior Art

Weapons such as mines are typically launched from submarines and other ocean going vessels. The portion of the ocean in which a mine is launched typically exhibits a current that affects the speed, course and run time of the mine. Typically, a weapons operator presets the mine based upon the desired aim point and does not utilize any information related to the effects of the ocean current in which the mine is launched. Thus, the operator will not have an estimate of the final distribution of mines and does not know if other mines have already been placed in the desired area. As a result, weapons retrieval is significantly difficult and time consuming.

There are many current systems and methods for determining paths of weapons such as torpedoes, rockets and projectiles. For example, U.S. Pat. No. 4,682,953 discloses a simulation system for determining the effectiveness of arms used in a battlefield environment. U.S. Pat. No. 5,556,281 discloses a method for simulating the effects of weapons on an area. U.S. Pat. No. 5,819,676 discloses a system for selecting acoustic homing beam offset angles for a torpedo in order to define a bounded area of insonification. U.S. Pat. No. 5,824,946 discloses a system for selecting a search angle for a torpedo. The system determines a set of aim points to include minimum/maximum aim points based on the weapon's capabilities. U.S. Pat. No. 6,186,444 discloses a method for determining the impact point of a ballistic projectile. U.S. Pat. No. 6,262,680 discloses a method estimating a rocket's trajectory and predicting its future position using geometric line of sight angles. However, the systems and methods described in these patents do not offer any scheme or methodology that would improve the process of determining the ultimate placement of a mine launched from a submarine or other vessel. U.S. Pat. No. 6,112,667 discloses a method for placing a mine in a constant current, but does not account for any errors in speed or direction in the current flow field.

What is needed is a system and method that will enable weapons operators to accurately predict where the mine will ultimately be positioned by including estimates of uncertain speed and direction of the ocean current flow field.

SUMMARY OF THE INVENTION

The present invention is directed to a method and apparatus that allows weapons operators to generate a distribution bounding region about desired aim points and determine the likelihood that the launched weapon will ultimately lie within that bounding region. The bounding region is based upon the initial weapon course and speed, the speed and course of the ocean flow field in which the weapon is launched, and the weapon run time. Specifically, the method uses modeled weapon dynamics and environmental conditions to determine required gyroscope angles and run distance in order to realize the specified weapon run path. The weapon run path comprises a sequence of intermediate points and aim points and starts at ownship position and terminates at the desired aim point. The present invention continuously re-computes the launch angle, run distance and gyroscope angles in response to ownship position and velocity updates and thus enables the weapons operator to determine and assess weapon presets. The method of the present invention can be implemented as part of a weapons order generation algorithm, also known as a WOG algorithm.

Thus, in one aspect, the present invention is directed to a method for determining a bounding region within which a launched weapon could ultimately be positioned. The course and speed of an ocean current flow field in which the weapon is launched is entered into a data processing system. The ownship position at weapon launch, and a bearing and range to a desired aim point from the ownship position are also inputted into the data processing system. The method processes the course and speed of ocean current, and the bearing and range to determine the resultant speed of the launched weapon. The method then processes the resultant speed of the launched weapon, the bearing and the course and speed of the ocean current to determine an offset course of the launched weapon. The method processes the ownship position at weapon launch, the desired aim point and the resultant speed of the launched weapon to determine the weapon run time. Next, a mathematical distribution of the uncertainty in the speed and course of the ocean current is entered into the data processing system. The method then processes the mathematical distribution to generate a scatter region of possible (X, Y) coordinate positions at which a launched weapon could be positioned. The method then processes the distribution function of the mathematical distribution and the desired aim point to determine a plurality of (X, Y) coordinate positions that define a bounding region. Next, the method determines the accuracy of the bounding region by quantifying the possible (X, Y) coordinate positions of the scatter region that are within the bounding region.

BRIEF DESCRIPTION OF THE DRAWINGS

The features of the invention are believed to be novel. The figures are for illustration purposes only and are not drawn to scale. The invention itself, however, both as to organization and method of operation, may best be understood by reference to the detailed description which follows taken in conjunction with the accompanying drawings in which.

DESCRIPTION OF THE PREFERRED EMBODIMENTS

Portions of ensuing description are presented in terms of algorithms and symbolic representations of operations on data bits within a computer memory. The algorithm presented here is a self-consistent sequence of steps leading to a desired result. These steps require physical manipulations of physical quantities. The physical quantities take the form of electrical or magnetic signals capable of being stored, transferred, combined, compared, and otherwise manipulated. These signals are commonly referred to as bits, values, elements, symbols, characters, terms, numbers, or the like. All of these and similar terms are to be associated with the appropriate physical quantities and are merely convenient labels applied to these quantities. In the ensuing discussion, discussions utilizing terms such as processing, computing, calculating, estimating, processing, determining and displaying refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Figure 1:
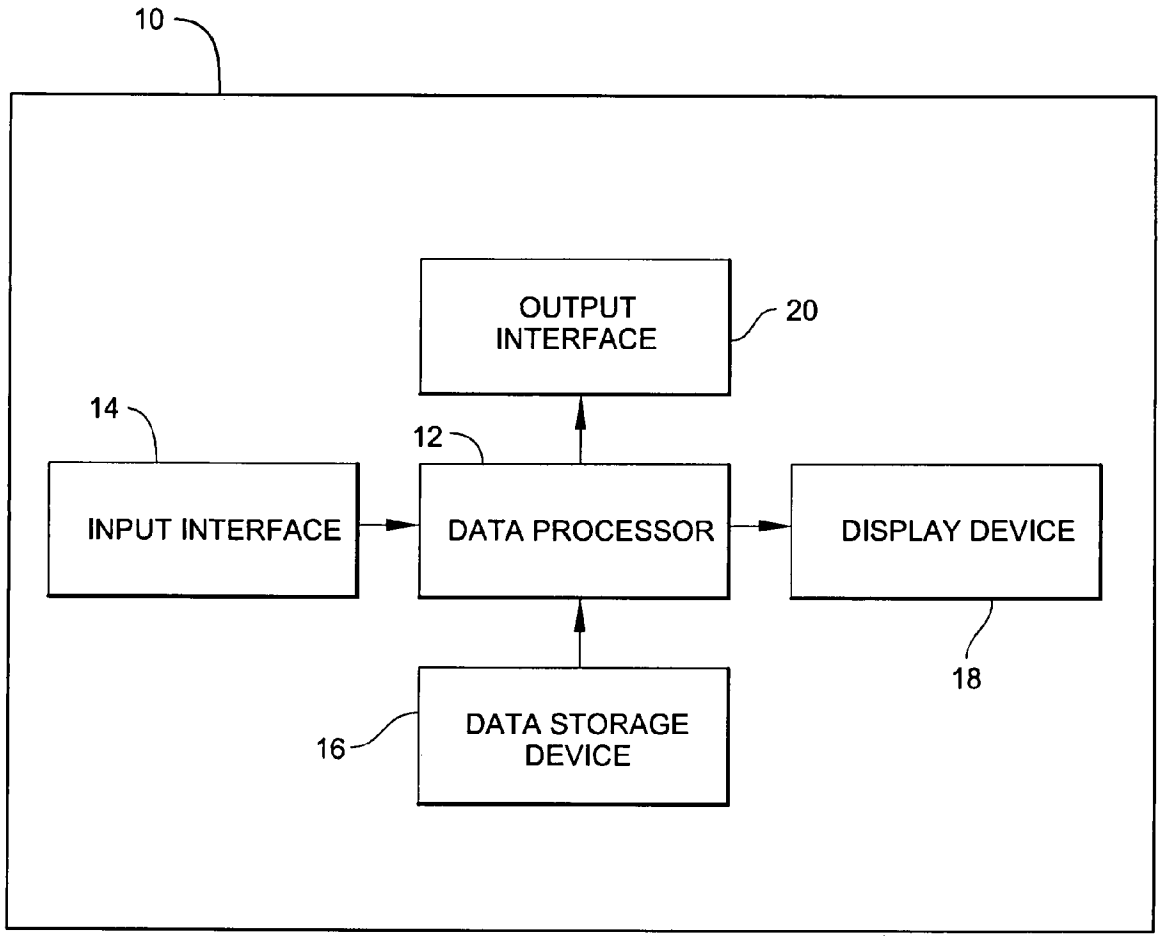
FIG. 1 is a block diagram of the system of the present invention.

Referring to FIG. 1, there is shown a block diagram of the data processing system 10 of the present invention. System 10 generally comprises data processor 12, input interface device 14, data storage device 16, display device 18 and output interface device 20. Data processor 12 may be realized as a general purpose computing device in the form of a computer, including a processing unit, and system memory. Data processor 12 comprises a central-processing unit (CPU), not shown but known in the art. In another embodiment, data processor 12 is configured as a plurality of processing units, commonly referred to as a parallel processing system. Data processor 12 may operate in a networked environment using logical connections to one or more remote computers. Input interface 14 is configured to allow input of data to data processor 12 in the form of manually inputted data or electronic signals provided by peripheral devices, such as a sonar signal processing devices. Data storage device 16 comprises memory devices such as a read-only-memory (ROM) and/or random-access-memory (RAM) for storing various estimations and/or pre-measured courses and speeds of ocean currents, and corresponding statistical distributions. Thus, known data relating to ocean currents all over the world can be stored in data storage device 16 along with corresponding pre-generated statistical distributions (e.g. Gaussian, Uniform, etc.).

Those skilled in the art will appreciate that the present invention may be practiced with other computer system configurations, including hand-held devices, multi-processor systems, microprocessor-based or programmable consumer electronics, network PC's, minicomputers, mainframe computers, etc.

Figure 2:
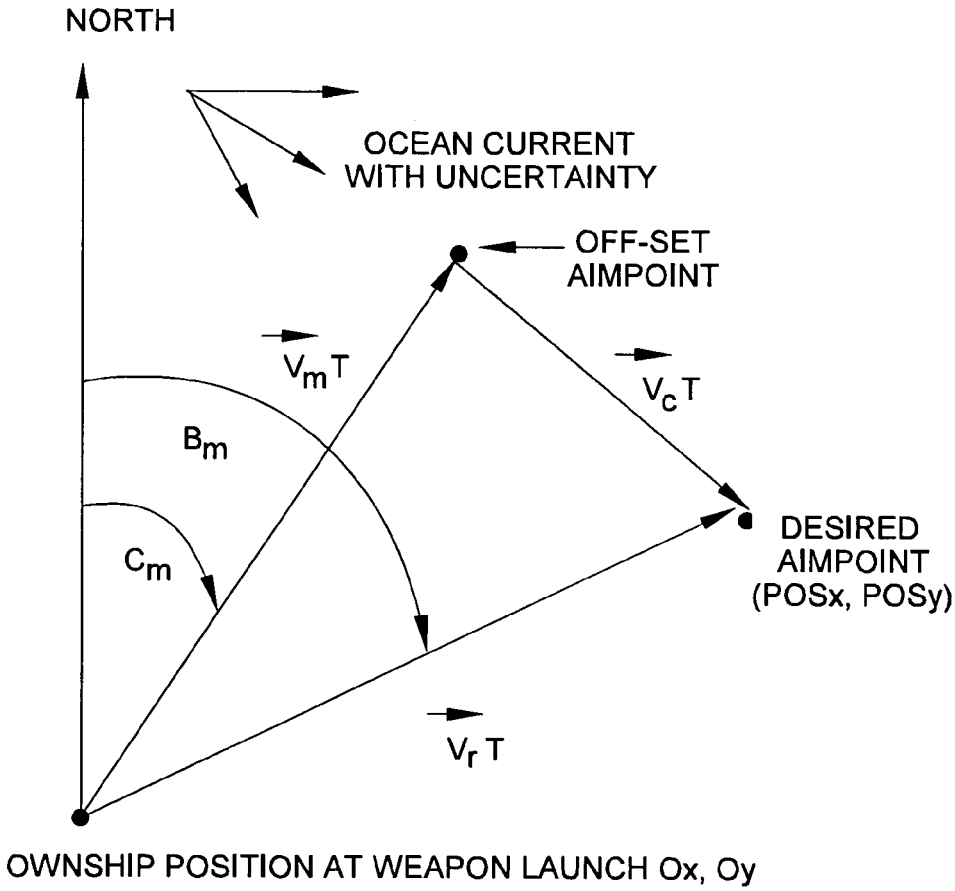
FIG. 2 is a vector diagram of mine placement in a current flow field.
Figure 3:
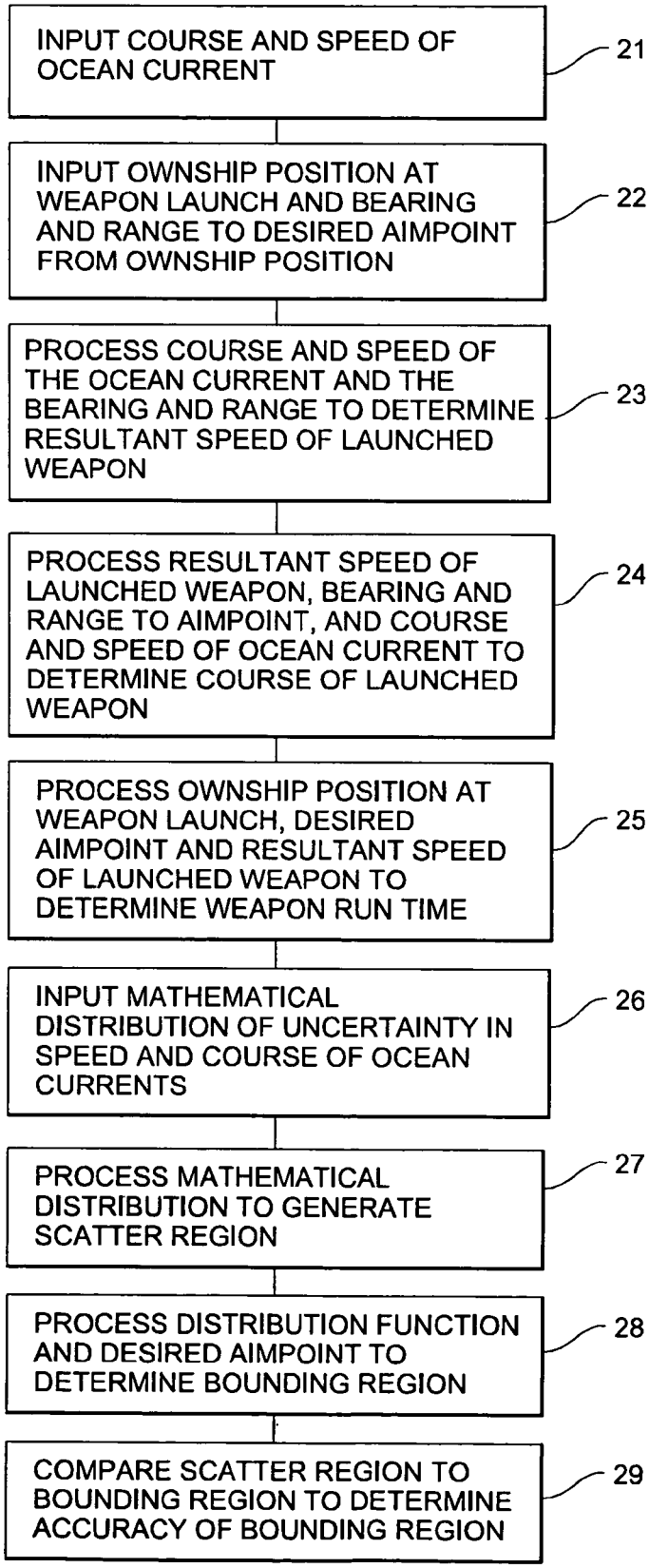
FIG. 3 is a flow chart of the method of the present invention.

The method of the present invention is shown as steps 21–29 in FIG. 3 and is taken in conjunction with the vector diagram of FIG. 2 in order to provide an understanding of the present invention. FIG. 2 shows a vector diagram of a launched mine traveling under the influence of ocean currents. Initially, the mine is launched on a course $C_m$ with a velocity vector $V_m$. However, the effects of an ocean current $V_c$ give a resulting weapon velocity vector of $V_r$. The mathematical expression that describes the influence of a known constant ocean current on a mine's trajectory (i.e. course and speed) is expressed through vector addition. Thus, the resultant mine velocity vector is represented by equation (1):

$$V_r=V_m+V_c \tag{1}$$

The rectangular form of equation (1) is shown as equations (2a) and (2b):

$$V_{rx}=S_r \sin(C_r)=V_{mx}+V_{cx}=S_m \operatorname{Sin}(C_m)+S_c \sin(C_c) \tag{2a}$$

$$V_{ry}=S_r \cos(C_r)=V_{my}+V_{cy}=S_m \cos(C_m)+S_c \cos(C_c) \tag{2b}$$

wherein:

$C_m$ is the initial course of the mine;

$S_m$ is the initial speed of the mine;

$C_c$ is the course of the ocean current;

$S_c$ is the speed of the current;

$C_r$ is the resultant course of the mine; and $S_r$ is the resultant speed of the mine.

In accordance with the present invention, data processor 12 is configured to implement equations (1), (2a) and (2b). The method of the present invention commences at step 21 wherein the course $C_m$ and speed $S_c$ of the ocean current flow field in which the weapon is launched is inputted into data processor 12. Equation (3) represents the resultant course of the mine $C_r$ as the mine transits through a constant ocean current to intercept a desired, fixed aim point position designated as ($POS_X$, $POS_Y$) (see FIG. 2), the resultant course of the mine $C_r$ is represented by equation (3):

$$C_r=B_m \tag{3}$$

wherein $B_m$ is the bearing to the desired aim point position ($POS_X$,$POS_Y$). In step 22, the ownship position coordinates ($O_X$, $O_Y$) at weapon launch, the bearing $B_m$, and the range to the desired aim point position ($POS_X$, $POS_Y$) are inputted into data processor 12. In step 23, data processor 12 processes all the data inputted in steps 21 and 22, in order to determine the resultant speed of the launched weapon. In terms of mathematical processing, step 23 performs the substitution of equation (3) into equations (2a) and (2b) thereby yielding equations (4a) and (4b):

$$S_r \operatorname{Sin}(B_m)=S_m \sin(C_m)+S_c \sin(C_c) \tag{4a}$$

$$S_r \cos(B_m)=S_m \cos(C_m)+S_c \cos(C_c). \tag{4b}$$

Step 23 performs the squaring and summing of equations (4a) and (4b) to yield equation (5):

$$S_r^2 = S_m^2 + S_c^2 + 2S_mS_c\left[\sin(C_c)\left[\frac{S_m\sin(B_m) - S_c\sin(C_c)}{S_m}\right] + \cos(C_c)\left[\frac{S_m\cos(B_m) - S_c\cos(C_c)}{S_m}\right]\right]. \tag{5}$$

Step 23 executes further processing steps in order to determine the solution of equation (5), which is the resultant speed of the launched weapon $S_r$. As a result, step 23 yields the solution expressed by equation (6):

$$S_r = S_c\cos(C_c - B_m) \pm \sqrt{S_c^2\cos^2(C_c - B_m) - S_c^2 + S_m^2}\,. \tag{6}$$

Step 23 processes equation (6) utilizes the data already inputted into data processor 12 in order to produce a value for the resultant speed $S_r$.

Next, in step 24, data processor 12 processes the resultant speed $S_r$ of the launched weapon, and the bearing and the course and speed of the ocean current in order to determine the weapon course $C_m$. Thus, in step 24 data processor 12 processes equations (4) and (6) to produce the weapon course $C_m$. Equation (7) is representative of this particular processing step performed data processor 12:

$$C_m = \tan^{-1}\left[\frac{S_r\sin(B_m) - S_c\sin(C_c)}{S_r\cos(B_m) - S_c\cos(C_c)}\right] \tag{7}$$

Once step 24 determines the weapon course $C_m$, step 25 determines the weapon run time T. In order to accomplish this, step 25 processes the ownship position ($O_X$, $O_Y$) at weapon launch, and the desired aim point ($POS_X$, $POS_Y$) to determine the weapon run time T. Equation (8) is representative of this particular processing step performed in step 25:

$$T = \frac{[(posx - O_x)^2 + (posy - O_y)^2]^{\frac{1}{2}}}{S_r} \tag{8}$$

Thus, if the ocean current speed and course are known, the data processing performed by steps 23, 24 and 25 will result in the weapon being placed at the desired aim point ($POS_X$, $POS_Y$).

Figure 4:
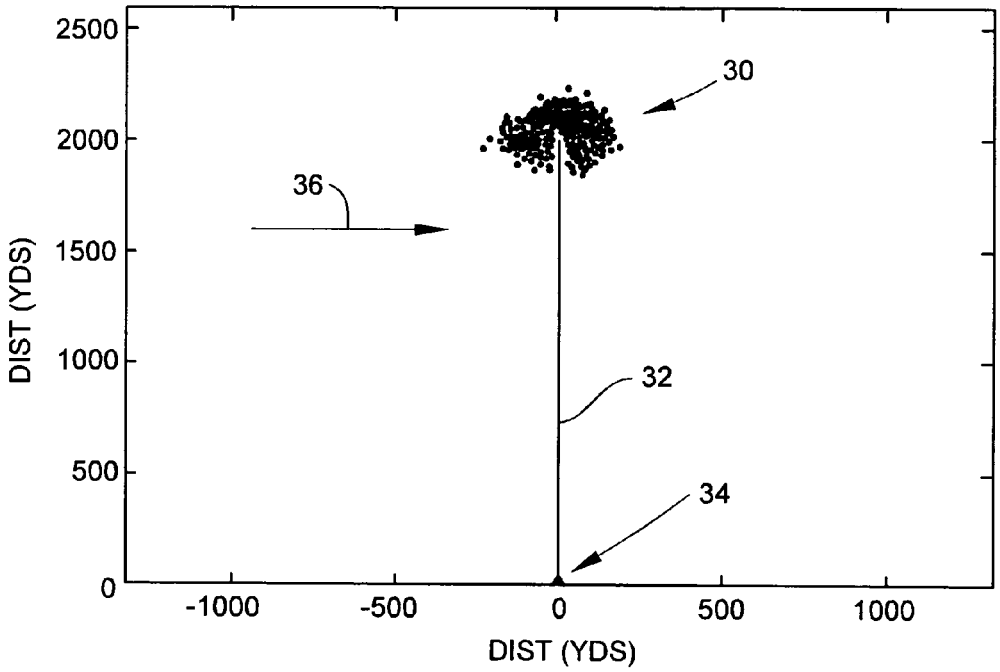
FIG. 4 is a graph showing a Gaussian scatter region.
Figure 5:
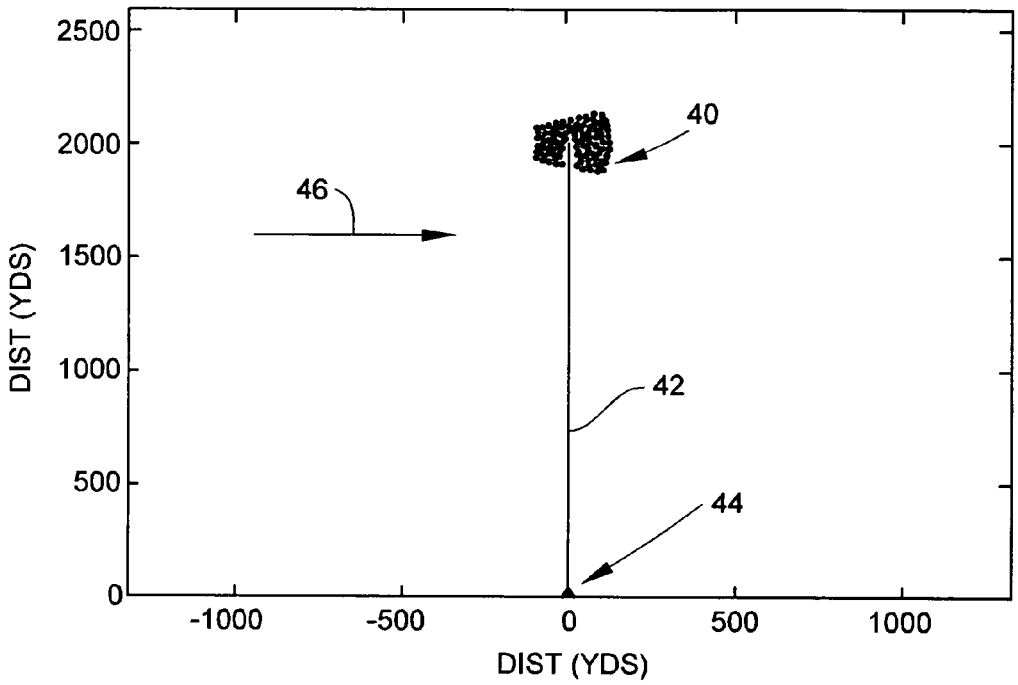
FIG. 5 is a graph showing a Uniform scatter region.

In many instances, the exact ocean current speed and course are not known and must be statistically estimated from measured data such as in-situ measurements or from apriori statistically averaged data. Such statistically estimated data is stored in data storage device 16 (see FIG. 1). In present invention determines the degradation in the overall accuracy of the mine placement due to estimation errors in the ocean current speed and course. The determined degradation is used to generate a bounding region within which the weapon is likely to be located. The bounding region provides information that enables the weapons operator to efficiently preset the weapon, and determine if there is already a satisfactory distribution of mines in a desired area of mine placement. The bounding region also enables a weapons operator to map locations of mines for future retrieval. Thus, in step 26, a known mathematical distribution of the uncertainty in the speed and course of the ocean current is inputted into data processor 12. The mathematical distribution has a corresponding distribution function. In one embodiment, the mathematical distribution is a Gaussian distribution. In another embodiment, the mathematical distribution is a Uniform distribution. Other suitable mathematical distributions can be used as well. Next, step 27 processes the mathematical distribution, the weapon course $C_m$, the resultant weapon speed $S_r$ and the weapon run time T to generate a scatter region of possible (X, Y) positions at which the launched weapon will likely be positioned. Specifically, step 27 performs a statistical simulation on the mathematical distribution. In one embodiment, the statistical simulation is a Monte Carlo statistical simulation. However, other statistical simulation methods can be used. As a result, step 27 results in the generation of N samples of ocean current course and speeds and a corresponding N weapon aim point positions based on the N samples of ocean current course and speeds. The N weapon aim point positions form a scatter region of mine positions. FIG. 4 shows scatter region 30 that is based on a Gaussian distribution of the ocean current course and speed. The preset path of the weapon is indicated by reference numeral 32. Ownship position at weapon launch is indicated reference numeral 34. Arrow 36 indicates the direction of the ocean current. The ocean current course and speed are 90 degrees and 5.0 yards/second, respectively. The uncertainty is modeled by zero mean Gaussian density functions with standard deviations of 10 degrees (for ocean course) and 1.0 yards/second (for ocean speed). The information shown in FIG. 4 is displayed by display device 18. FIG. 5 shows scatter region 40 that is based on a Uniform distribution of the ocean current course and speed. The preset path of the weapon is indicated by reference numeral 42. Ownship position at weapon launch is indicated by reference numeral 44. Arrow 46 indicates the direction of the ocean current. The ocean current course and speed are 90 degrees and 5.0 yards/second, respectively. The uncertainty is modeled by zero mean Gaussian density functions with standard deviations of 10 degrees (for ocean course) and 1.0 yards/second (for ocean speed). In an alternate embodiment, step 26 processes the data representing the known ocean current speed and course, or data representing estimated ocean current speed and course, and then generates a mathematical distribution of the uncertainty in the speed and course of the ocean current.

Next, step 28 processes the distribution function of the mathematical distribution and the desired aim point ($POS_X$, $POS_Y$) to generate a plurality of critical (X, Y) coordinate positions that define a bounding region. Specifically, step 28 processes the statistics (e.g. mean and variance) of the distribution function and implements equations (9a)–(14b) to generate a plurality of critical (X, Y) coordinate positions:

$$C_{1x}=POS_X+(S_c-n_s sig_s)\sin(C_c-n_c sig_c)T \tag{9a}$$

$$C_{1y}=POS_Y+(S_c-n_s sig_s)\cos(C_c-n_c sig_c)T \tag{9b}$$

$$C_{2x}=POS_X+(S_c-n_s sig_s)\sin(C_c+n_c sig_c)T \tag{10a}$$

$$C_{2y}=POS_Y+(S_c-n_s sig_s)\cos(C_c+n_c sig_c)T \tag{10b}$$

$$C_{3x}=POS_X+(S_c-n_s sig_s)\sin(C_c+n_c sig_c)T \tag{11a}$$

$$C_{3y}=POS_Y+(S_c-n_s sig_s)\cos(C_c-n_c sig_c)T \tag{11b}$$

$$C_{4x}=POS_X+(S_c-n_s sig_s)\sin(C_c+n_c sig_c)T \tag{12a}$$

$$C_{4y}=POS_Y+(S_c-n_s sig_c)\cos(C_c+n_c sig_c)T \tag{12b}$$

$$C_{5x}=POS_X+(S_c-n_s sig_s)\sin(C_c)T \tag{13a}$$

$$C_{5y}=POS_Y+(S_c-n_s sig_s)\cos(C_c)T \tag{13b}$$

$$C_{6x}=POS_X+(S_c+n_s sig_s)\sin(C_c-n_c sig_c)T \tag{14a}$$

$$C_{6y}=POS_Y+(S_c+n_s sig_s)\cos(C_c-n_c sig_c)T \tag{14b}$$

wherein:

$POS_X$, $POS_Y$ are the (X, Y) positions at the desired aim point;

$sig_c$, $sig_s$ are standard deviations for the ocean course and speed, respectively; and $n_c$, $n_s$ are modeling constants.

Figure 6:
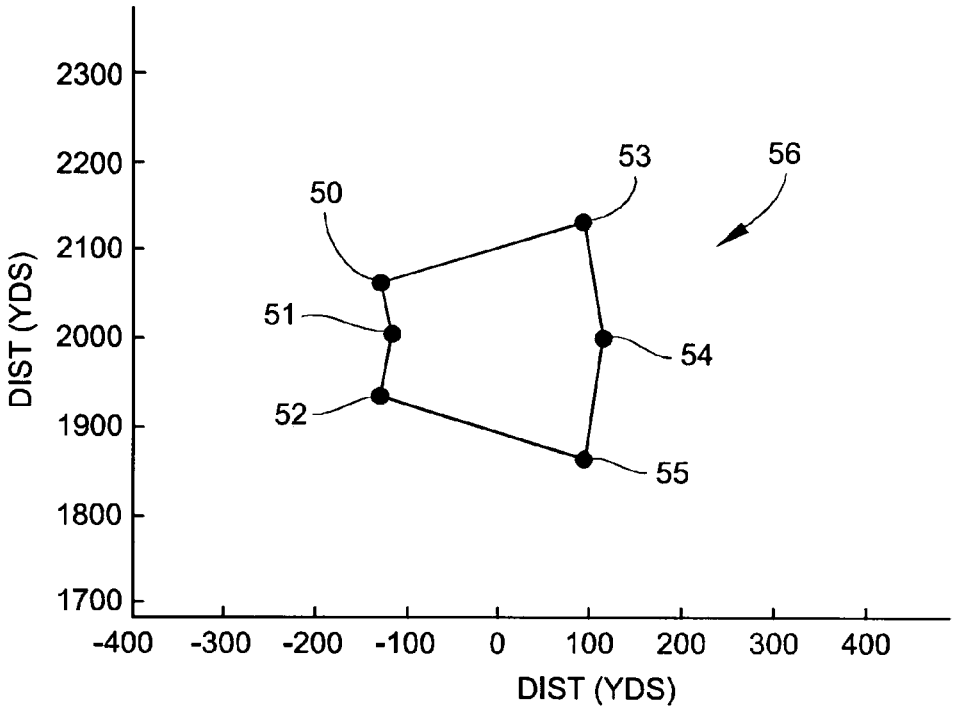
FIG. 6 is a graph showing critical points used to describe the bounding region.
Figure 7:
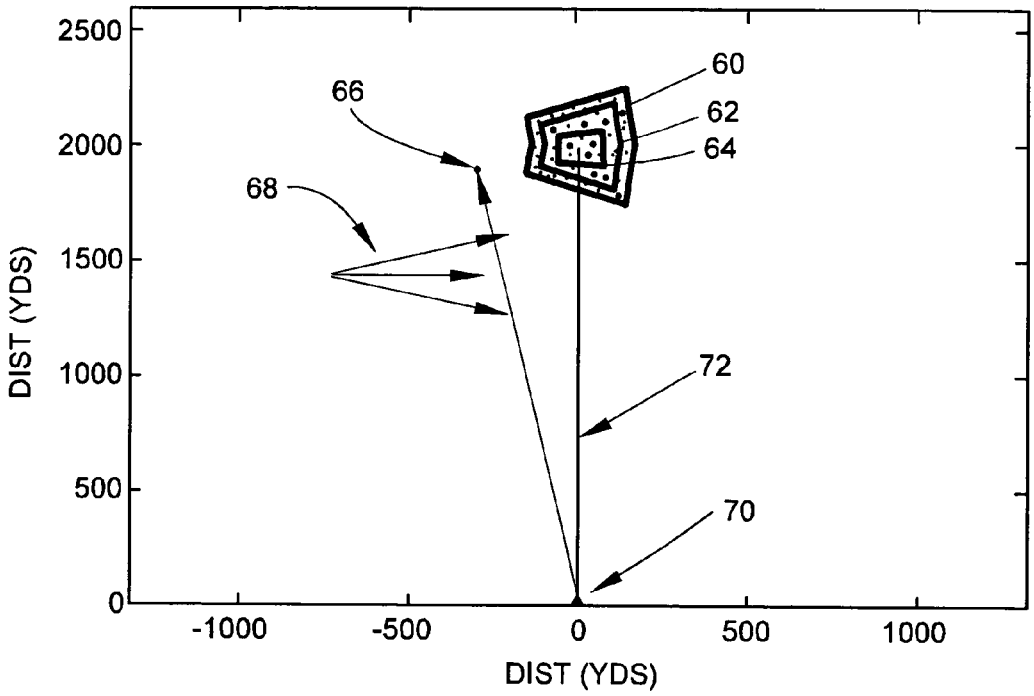
FIG. 7 is a graph showing one, two and three sigma bounding regions for Gaussian positional uncertainty.
Figure 8:
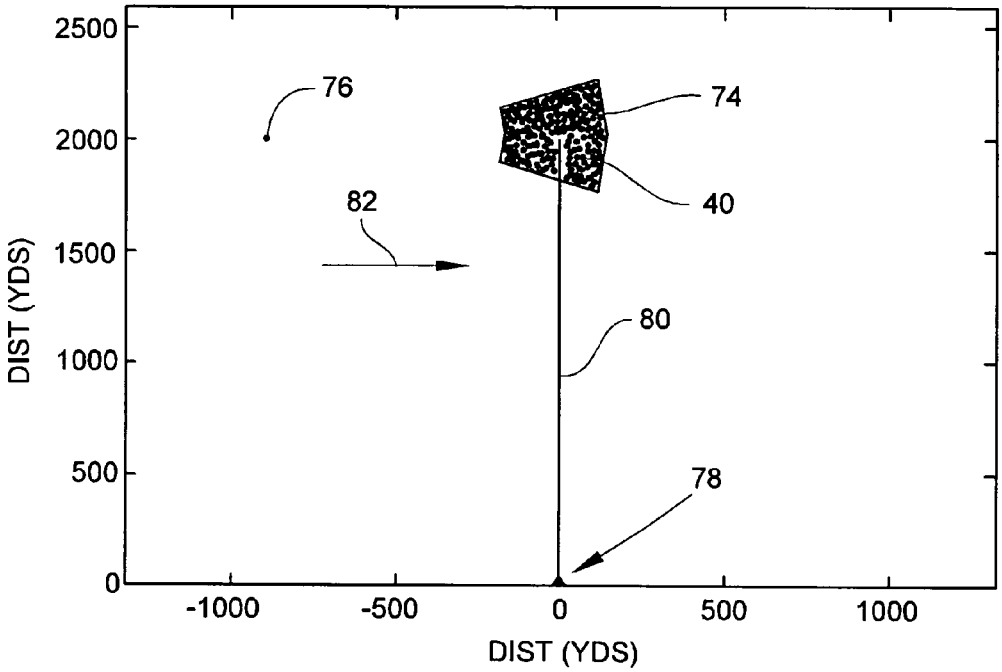
FIG. 8 is a graph showing a bounding region for Uniform positional uncertainty.

Formulae (9a), (9b), (10a), (10b), (11a), (11b), (12a), (12b), (13a), (13b), (14a) and (14b) yield six critical points 50–55 that define bounding region 56 that is shown in FIG. 6. Various sized bounding regions are obtained through the selection of the appropriate values for the modeling constants $n_c$, $n_s$. FIG. 7 shows three bounding regions 60, 62 and 64 of different sizes that are based on the Gaussian scatter region shown in FIG. 4 and different modeling constant values. Specifically, the values of the modeling constants were set to one, two and three to obtain bounding regions 60, 62 and 64, respectively. Only bounding region 64 bounds substantially all possible (X, Y) coordinate positions at which the weapon will likely be positioned. Thus, in a preferred embodiment, the value of each modeling constants is three. The offset aim point is indicated by reference numeral 66. The ocean current speed and course with errors is indicated by reference numeral 68. Ownship position at weapon launch is indicated by reference numeral 70. The resultant weapon path is indicated by reference numeral 72. FIG. 8 shows bounding region 74 that is based on the Uniform scatter region 40 shown in FIG. 5 and modeling constants that were equal to the end points of the density function. The offset aim point is indicated by reference numeral 76. Ownship position at weapon launch is indicated by reference numeral 78. The resultant path of the weapon is indicated by reference numeral 80. The mean direction of ocean current is indicated by reference numeral 82. Step 29 determines the accuracy of the bounding region by quantifying the portion of the scatter region that lies within the bounding region. Specifically, step 29 compares the scatter region to the bounding region to quantify the (X, Y) coordinate positions that lie within the bounding region. In a preferred embodiment, step 29 determines the percentage of the total number of (X, Y) coordinate positions that are located within the bounding region. As the data defining the ocean current and speed becomes more exact, the percentage of the total number of (X, Y) coordinate positions that are located within the bounding region increases. As the data defining the ocean current and speed becomes less exact, the percentage of the total number of (X, Y) coordinate positions that are located within the bounding region decreases. Thus, step 29 determines the likelihood that the launched weapon will ultimately be positioned within the bounding region based on the available ocean current speed and course information. In a preferred embodiment, display device 18 displays the scatter region and bounding region in such a manner that the scatter region is superimposed over the bounding region in order to facilitate the determination of the accuracy of the bounding region.

Referring to FIG. 1, output interface 20 outputs all data generated by data processor 12 to other devices such as weapons control devices, sonar processing equipment, etc. In a preferred embodiment, all data generated by data processor 12 is stored in data storage device.

The capability of the present invention to generate bounding regions for various uncertainties in ocean current and speeds significantly aids weapons operators in mine placement and retrieval. The present invention enables weapons operators to efficiently preset the weapon, quickly assess if there is a satisfactory distribution of mines in the area of operation, and map mine locations for future retrieval.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. For example, rather than use an (X, Y) coordinate system, a latitude and longitude coordinate system could be employed. On a small scale using a latitude and longitude coordinate system would require a simple transformation of the equations. On a large scale, where larger areas of open sea would be involved, the underlying equations would need to address the inherent curvature of the surface of the globe when using the spherical coordinates of latitude and longitude.

Accordingly, the foregoing detailed description should be considered exemplary in nature and not limited to the scope and spirit of the invention as set forth in the attached claims.

What is claimed is:

1. A method for determining a bounding region within which a launched weapon will be located comprising:

providing a data processing system with a course and speed of an ocean current flow field in which the weapon is launched;

providing the data processing system with an ownship position at weapon launch, and a bearing and range to a desired aim point from the ownship position;

processing the course and speed of the ocean current flow field, the bearing and range to determine the resultant speed of the launched weapon;

processing the resultant speed of the launched weapon, the bearing and the course and speed of the ocean current flow field to determine a course of the launched weapon;

processing the ownship position at weapon launch, the desired aim point and the resultant speed of the launched weapon to determine a weapon run time;

providing the data processing system with a mathematical distribution of the uncertainty in the speed and course of the ocean current, the mathematical distribution having a distribution function;

processing the mathematical distribution to generate a scatter region of possible coordinate positions at which a launched weapon could possibly be located;

processing the distribution function and the desired aim point to determine a plurality of coordinate positions that define a bounding region;

determining the accuracy of the bounding region by quantifying the possible coordinate positions of the scatter region that are within the bounding region; and displaying said bounding region and said scatter region on a graphical medium.

2. The method according to claim 1 wherein the step of providing a data processing system with a course and speed of an ocean current flow field in which the weapon is launched comprises estimating the course and speed of the ocean current flow field.

3. The method according to claim 1 wherein the mathematical distribution is a Gaussian distribution.

4. The method according to claim 1 wherein the mathematical distribution is a Uniform distribution.

5. The method according to claim 1 wherein the coordinates are spatial coordinates (X, Y).

6. The method according to claim 1 wherein the coordinates are spherical coordinates of latitude and longitude.

7. The method according to claim 1 wherein processing the mathematical distribution comprises performing a statistical simulation on the mathematical distribution.

8. The method according to claim 7 wherein the statistical simulation is a Monte Carlo statistical simulation.

9. The method according to claim 1 wherein displaying said bounding region and said scatter region on a graphical medium comprises displaying the scatter region and the bounding region with a display device of the data processing system.

10. The method according to claim 9 wherein displaying the scatter region and bounding region comprises displaying the scatter region and bounding region in a manner that the scatter region is superimposed over the bounding region.

* * * * *